US007914229B2

(12) United States Patent
Aubusson et al.

(10) Patent No.: US 7,914,229 B2
(45) Date of Patent: Mar. 29, 2011

(54) DRAIN COVER PORTION

(75) Inventors: Alastair Aubusson, Hertfordshire (GB); Rob King, Hertfordshire (GB)

(73) Assignee: ACO Polymer Products, Inc., Chardon, OH (US)

( * ) Notice: Subject to any disclaimer, the term of this patent is extended or adjusted under 35 U.S.C. 154(b) by 860 days.

(21) Appl. No.: 11/749,819

(22) Filed: May 17, 2007

(65) Prior Publication Data

US 2007/0274781 A1 Nov. 29, 2007

(51) Int. Cl.
*E02B 11/00* (2006.01)

(52) U.S. Cl. ..... 405/36; 405/43; 405/47; 405/51; 405/118; 405/119; 405/120; 405/121; 405/136; 210/163; 210/164; 52/12; 52/92.2; 52/169.7; 52/654.1; 52/655.1; 4/510; 604/317

(58) Field of Classification Search ..... 52/12, 92.2, 52/169.7, 654.1, 655.1; 405/36
See application file for complete search history.

(56) References Cited

U.S. PATENT DOCUMENTS 2,305,955 A 12/1942 Dudley
4,126,404 A * 11/1978 Ferns ..... 404/4
5,181,793 A * 1/1993 Dekel ..... 404/4
5,454,663 A * 10/1995 Stegmeier ..... 404/2
6,113,311 A * 9/2000 Becker et al. ..... 405/119
6,729,795 B2 * 5/2004 Dahowski et al. ..... 404/4

FOREIGN PATENT DOCUMENTS

FR 2 653 457 4/1991
GB 2 388 144 11/2003
GB 2388144 * 11/2003

OTHER PUBLICATIONS

International Search Report (EP 06 11 4531) dated Oct. 27, 2006.

* cited by examiner

*Primary Examiner* — Tatyana Zalukaeva
*Assistant Examiner* — Ilya Y Treyger
(74) *Attorney, Agent, or Firm* — Pearne & Gordon LLP

(57) ABSTRACT

A drain cover portion (100*a*, 100*b*) for a linear drainage system which comprises at least two attachment means. The attachment means are provided by at least one a connector attachment means (500) and at least one drain attachment means (700). The connector attachment means (500) is arranged to attach one or more anchor connectors (1002) for connecting an anchor (114) to the drain cover portion (100*a*, 100*b*) and/or one or more cover portion connector for connecting said drain cover portion (100*a*, 100*b*) to another drain cover portion (100*a*, 100*b*). The drain attachment means (700) is arranged to attach a drain portion (200) to the drain cover portion (100*a*, 100*b*). Each attachment means is arranged so as to allow the tool-less attachment of a connector/drain section.

24 Claims, 14 Drawing Sheets

DRAIN COVER PORTION

The present invention relates to a drain cover portion for drainage systems, to drainage systems including drain cover portions and, in particular but not exclusively, to surface drainage systems and drain cover portions for surface drainage systems.

Drain covers are generally provided over inlets to drainage systems to stop leaves, litter and other detritus from entering the drainage systems and causing blockages. Drain covers also contribute to the strength of the drainage system structure. These covers usually take the form of grates or slotted members with the holes in the cover which are small compared to the size of the bore in the drainage system.

Linear surface drainage systems are arranged to allow water to drain from a surface such as a car park, road or the like. Typically, a linear surface drainage system is installed as follows. First, a trench is dug into the ground below the surface to be drained and linear, prefabricated components, such as U-shaped lengths of trench drain pipes, are laid into the trench and joined together to form a continuous drain. A drain cover portion comprising a length of substantially rectangular plastic or metal grate is placed over the open mouth, or inlet, of the drain and the drainage system is secured in position, usually by pouring concrete into the trench around the outside of the drain and/or by flanking it with paving stones or similar building blocks.

It is normally desirable to install a drainage system in as short a time frame as is possible. In order to achieve this, some prior art systems comprise lengths of drain cover which simply abut each other. However, in such systems, the drain cover portions may become misaligned, either moving away from the inlet of the drain and thus not covering the inlet or raising up so as to become a hazard to people or traffic passing over the drain cover. In addition, the cover portions can rise or shift as concrete is poured around the drain. Once the concrete sets, the drain cover portions can become firmly set in their misaligned position.

In some prior art systems, this problem is addressed by providing a mechanical connection, for example a bolt, which either bolts portions of drain cover together or bolts portions of drain covers to the underlying drainage system. However, such systems are time consuming to install and contain separate components that can be mislaid on site.

Other prior art systems have addressed the problem of securely siting a drain cover by providing the cover with projecting anchors which provide tangs around which the concrete can be cast to ensure that the cover is fully clamped into the concrete. However, the provision of such anchors limits the potential use of the covers as the covers cannot be used where the trench drain is to be situated between paving stones or blocks.

In further prior art drainage systems, the cover is integral to, or permanently fixed to, a drain section. This has the disadvantage that if the drain cover becomes damaged, for example during installation, the whole drain section becomes unusable; this is unduly wasteful.

Some prior art drain covers are arranged to lie below the surface to be drained to ensure that they drain effectively as if the drain cover is flush with the surface there is a risk that, due to its surface tension, the water will flow over the top of the cover rather than passing into the drain.

There is a problem associated with such inset drainage systems, in that they provide a discontinuity in the surface to be drained. Taking the example of a drainage system in a car-park, this means that car drivers passing over the drainage system feel a bump. The discontinuity can be sufficient to, for example, dislodge a load carried by a forklift truck. Inset drainage systems can also prove an obstacle in particular to the progress of vehicles with a relatively small wheel diameter, such as trolleys and pushchairs as they cross the drainage system. Where the wheels come to rest in the inset portion, it can take considerable force to move the wheel on, particularly where the vehicle is heavily laden as is often the case with supermarket trolleys.

According to a first aspect of the invention, there is provided a drain cover portion for a drainage system, the drain cover portion comprising at least two attachment means comprising one or more of each of the following:

- a connector attachment means, arranged to attach one or more anchor connectors for connecting an anchor to the drain cover portion and/or one or more cover portion connectors for connecting said drain cover portion to another drain cover portion; and
- a drain attachment means, arranged to attach a drain portion to the drain cover portion,
- wherein each attachment means is arranged so as to allow the tool-less attachment of a connector and of a drain section.

Such a drain cover potion is convenient as it facilitates the installation of a drainage system. The attachment of anchor connectors allow the drain cover portions to be firmly located in concrete by the use of anchors attached thereto. The attachment of cover portion connectors allows drain cover portions to be linked together to prevent misalignment of drain cover portions. The drain attachment means is convenient as this will securely site the drain cover portion on a drain section. All three attachment means act to provide attachments which are generally convenient but in certain circumstances are undesirable. For example, in some circumstances, anchors are generally desirably but a drain cover portion including an anchor may not be suitable due to the intended material to surround a portion of the drainage system. Equally, a drain cover portion will generally be connected to another drain cover portion, except where it is the end portion. The drain attachment means will generally be useful for connecting a drain cover portion to a drain, but it may occasionally be necessary to separate the drain cover portion from the drain, for example if the drain cover portion or drain portion becomes damaged. Tool-less assembly of a drainage system is convenient as it allows for quick and easy assembly of the drainage system where connectors and drain attachment is convenient.

Preferably, the or each connector attachment means is adapted to attach an anchor connector or a cover portion connector interchangeably. This is convenient as it allows the drain cover portion to be adaptable.

Preferably, at least one of the or each attachment means is arranged to allow the tool-less detachment of a connector and/or a drain section. Alternatively, at least one of the or each attachment means is arranged to allow the detachment of a connector and/or a drain section by use of a lever. This is convenient as it allows for the ready disassembly of a drainage system in the event that an element thereof become damaged, or does not meet the requirements of a chosen installation site for the drainage assembly.

In one embodiment, the connector attachment means is a cut-out portion. This provides a convenient attachment means which a connector can latch onto and which is easy to manufacture.

Preferably, the drain cover portion comprises a plurality of connector attachment means. This adds to the versatility of the drain cover portion. In particular, a drain cover portions may require cutting in order to cover an exposed drain portion of a particular length. Providing a series of connector attachment means distributed along a length of the drain cover portion is therefore advantageous as there will be connector attachment means remaining on the drain cover portion even after a length thereof has been cut off. This is particularly advantageous in embodiments where each connector attachment means is adapted to attach an anchor connector or a cover portion connector interchangeably as, following cutting, it may be appropriate that a particular attachment means is used to attach, for example, a cover portion connector rather than for an anchor connector.

In one embodiment, the drain attachment means arranged to attach the drain cover portion to the drain portion is a gripping means arranged to form an interference fit between the drain cover portion and a drain portion. This is advantageous as it allows for the ready assembly of a drainage system.

In a preferred embodiment, the drain attachment means comprises a material and a configuration such that it will bite into plastics material. This is advantageous as drain often comprise plastics material and such a drain attachment means will provide a secure fit with a drain comprising a plastics material.

In one embodiment, the drain cover portion comprises a load bearing portion arranged to provide a surface capable of withstanding pressure from vehicles, persons or the like and comprising an inset member, wherein the inset member bears a plurality of projections on an upper face thereof, and the inset member is arranged such that, in use of the drain cover portion, it is below the level of a surface to be drained, and the tops of the projections are substantially level with the surface to be drained.

This is advantageous as an inset member provides for efficient water capture and the projections allow wheeled vehicles to pass over the cover without obstruction.

According to a second aspect of the invention, there is provided a component of a modular drainage system, said component comprising a drain cover portion and a drain portion attached thereto by a drain attachment means, at least one connector attachment means arranged to allow the attachment of at least one removeably mounted connector, and at least one connector removeably mounted to the connector attachment means and comprising at least one of an anchor connector arranged to connect an anchor to the component and a component connector arranged to connect the component to another drainage system component, when the or each connector is arranged such that it can be removed and/or mounted on the component without the need for tools.

This provides a versatile drainage system component. The component may be readily installed as part of a modular drainage system including the attached connectors in most applications. However, in some circumstances a drain cover portion including an anchor may not be suitable due to the material intended to surround a portion of the drainage system. Instead of providing a first type of component including anchors, (which, where they can be used, are advantageous as they allow the drain cover portion to be firmly held in the ground or concrete surrounding the drainage system), and a second type of component without anchors, anchors can simply be removed from part of a component as necessary. Equally, a component will not require connection to another drain cover portion where it is the end portion. In this circumstance, the cover portion connector can be simply removed. In prior art systems, the end portions had to be cut off, which is time consuming. Further, tool-less attachment and detachment is advantageous as it allows for quick and simple adaptation of the component to suit the intended position of the component.

In one embodiment, the connector comprises at least one resilient member which is arranged to interact with the attachment means and is manually deformable. This provides a convenient means for the tool-less attachment and/or detachment of a connector.

Preferably the connector is arranged to lie in the plane of the component. In a preferred embodiment, the connector is arranged to lie substantially within the profile of the component. This is advantageous as any substantially protruding parts of the connector may be liable to be damaged, for example during installation of the component. It also allows for building blocks to be laid directly against the side of the drain cover portions when arranged in situ. This produces a neater finish to an inlaid drainage system.

The connector may comprise a graspable portion which projects from the connector such that it is accessible to a user when the connector is attached to a component.

Preferably, each connector attachment means is arranged to allow connection of anchor connector or a cover portion connector interchangeably. This adds to the versatility of the component.

Preferably, the component comprises a plurality of connector attachment means. In one embodiment, the number of connector attachment means is greater than the number of connectors. This is advantageous for anchor connectors, which can be moved to a different position unoccupied by another connector on the component if their original position interferes with the intended surroundings of the component. Therefore, a preferred number of anchors can be provided even if the anchor cannot be situated in its original position. Further, if the component is cut to size, a cover portion connector may be required to connect to an alternative connector attachment means.

Preferably, the drain attachment means is arranged such that the drain cover portion can be separated from the drain portion. This is convenient as, should the drain cover portion or the drain portion become damaged, the damaged part can be replaced instead of needing to replace the component in its entirety. In a preferred embodiment the drain attachment means is arranged to allow the tool-less separation of the drain cover portion and the drain portion. Alternatively, the drain attachment means may be arranged to allow the separation by use of a lever such as a screw driver or a crowbar.

Preferably, the anchor connector is integrally formed with an anchor. This is convenient as incorporating the connector in the anchor reduces the number of elements required to construct a drainage system with anchors.

Preferably, the component connectors are arranged to connect components to such that both the horizontal and the vertical alignment of adjacent components is assured. In one embodiment, the alignment is assured by providing a projecting portion on each component and a complementary recessed portion on the component connector such that the connector can only attach to the attachment means if the recessed portion of the connector is located over the projecting portion of the drain cover portion to be connected.

In one embodiment, the drain cover portion comprises a drain cover portion according to the first aspect of the invention.

In one embodiment, the anchor connectors and the cover portion connectors comprise connectors according to the third aspect of the present invention.

According to a third aspect of the invention, there is provided a drainage system connector, arranged to be attached to a drainage system component and comprising at least one resilient member which is manually deformable. This provides a convenient connector which may be attached to a drainage system component without the need for tools.

Preferably, the connector comprises a single component. This is advantageous when compared to, for example, nuts and bolts or other two-part components, which must be manufactured separately. Further, one component can become lost and the connector is then useless.

The connector may comprise a graspable portion arranged to project from the connector such that it is accessible to a user when the connector is attached to a component. This allows the connector to be readily removed from a component to which it is attached.

Preferably, the connector comprises a recessed portion such that the connector can only attach to the attachment means if the recessed portion of the connector is located over a complementary projecting on the or each component. This ensures that the connector is correctly positioned on the component(s). Alternatively, the connector may comprise a projecting portion and the component may comprise a complementary recessed portion.

In one embodiment, the connector comprises an integrally formed anchor arranged to provide a tang around which concrete can set. This is a useful attachment for a drainage system.

Preferably, the anchor comprises a substantially vertical portion proximal to the anchor connector, and an angled portion distal from the anchor connector arranged such that, in use of a drain cover portion incorporating an anchor, a building element may be placed adjacent to the vertical portion and the angled portion at least partially enters the area below the footprint of the building element.

In one embodiment, the connector comprises a drain cover portion connector arranged to link a drain cover portion to an adjacent drain cover portion. This provides a convenient means for linking and ensuring the alignment of drain cover portions.

Preferably, the connector is symmetrical about a midline lying, when the connector is attached to a drainage system, in the plane of the drainage system. This is advantageous as the same connector can be used on either side of the drainage system.

According to a fourth aspect of the invention there is provided a kit for the manufacture of a component of a modular drainage system comprising:

at least one drain cover portion for a drainage system, a connector attachment means, arranged to attach one or more of an anchor connector arranged to connect an anchor to the drain cover portion and/or one or more of a cover portion connector arranged to connect said drain cover portion to another drain cover portion, a drain attachment means, arranged to attach the drain cover portion to a drain portion, at least one anchor connector, and at least one cover portion connector, wherein the anchor connector(s) and/or the cover portion connector(s) are arranged to attach to the connector attachment means without the use of tools and the drain attachment means is arranged to attach the drain cover portion and the drain portion without the need for tools.

The kit may further comprise a drain portion.

In one embodiment, the kit comprises a kit for the manufacture of a component according to the second aspect of the invention.

According to a fifth aspect of the present invention there is provided a surface drain cover portion comprising a load bearing portion arranged to withstand pressures from vehicles, persons and the like passing thereover, and comprising an inset member bearing a plurality of projections on an upper face thereof, wherein the inset member is arranged such that, in use of the drain cover portion, it is below the level of the surface to be drained, and the tops of the projections are substantially level with the surface to be drained.

This is advantageous as an inset member provides for efficient water capture and the projections allow wheeled vehicles to pass over the cover without obstruction Preferably, the drain cover portion is for use with a linear drainage system. This is particularly advantageous because such drainage systems tend to transect areas such as car parks and the like and are therefore hard to avoid with a wheeled vehicle when crossing such an area.

Preferably, the projections are separated by a distance which is less than the average width of a wheel which is expected to pass thereover. This is so that a wheel will be supported by at least one projection. In a preferred embodiment, the projections are separated by a distance which is less than the smallest width of a wheel expected to pass thereover.

Preferably, the inset portion comprises drainage slots arranged to allow water to drain therethrough.

In one embodiment, the drain cover portion comprise a drain cover portion according to the first aspect of the invention.

According to a sixth aspect of the invention, there is provided a drain cover portion for a drainage system, the drain cover portion comprising at least one attachment means comprising one or more of at least one of the following:

a connector attachment means, arranged to attach one or more anchor connector for connecting an anchor to the drain cover portion and/or one or more cover portion connector for connecting said drain cover portion to another drain cover portion; and a drain attachment means, arranged to attach a drain portion to the drain cover portion, wherein each attachment means is arranged so as to allow the tool-less attachment of a connector and of a drain section.

Any of the aspects of the invention may incorporate features from other aspects of the invention.

Embodiments of the invention are now described, by way of example only, and with reference to the accompanying Figures, of which:

Figure 1:
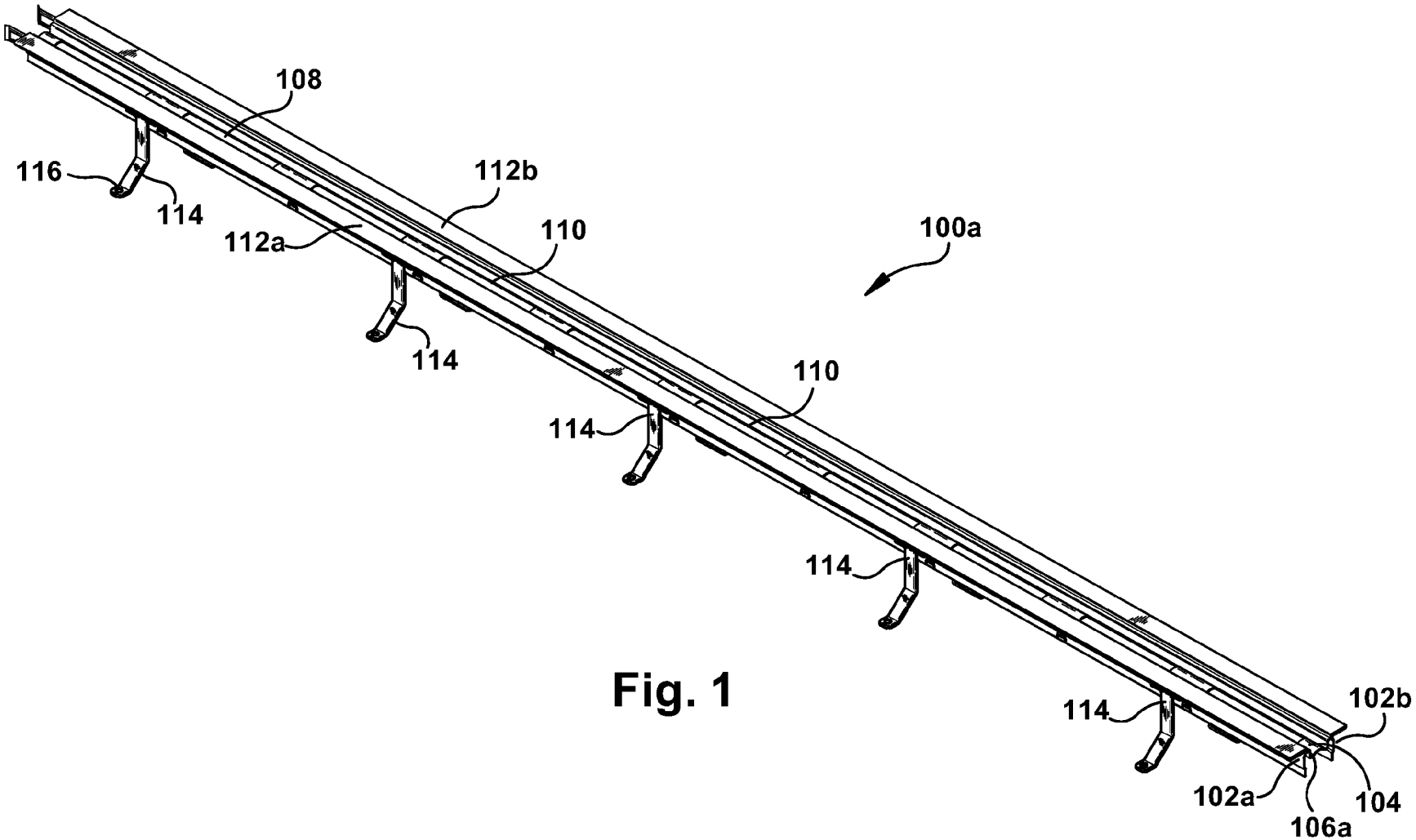
FIG. 1 shows a drain cover portion according to one embodiment of the present invention.
Figure 7B:
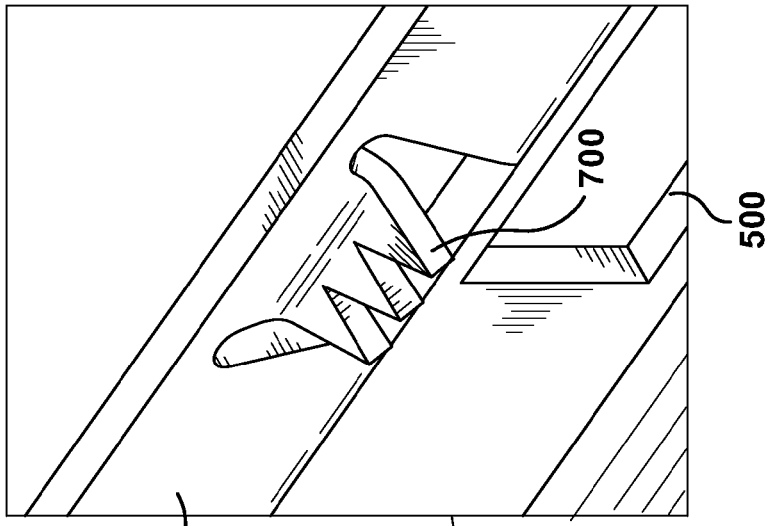
Figure 7A:
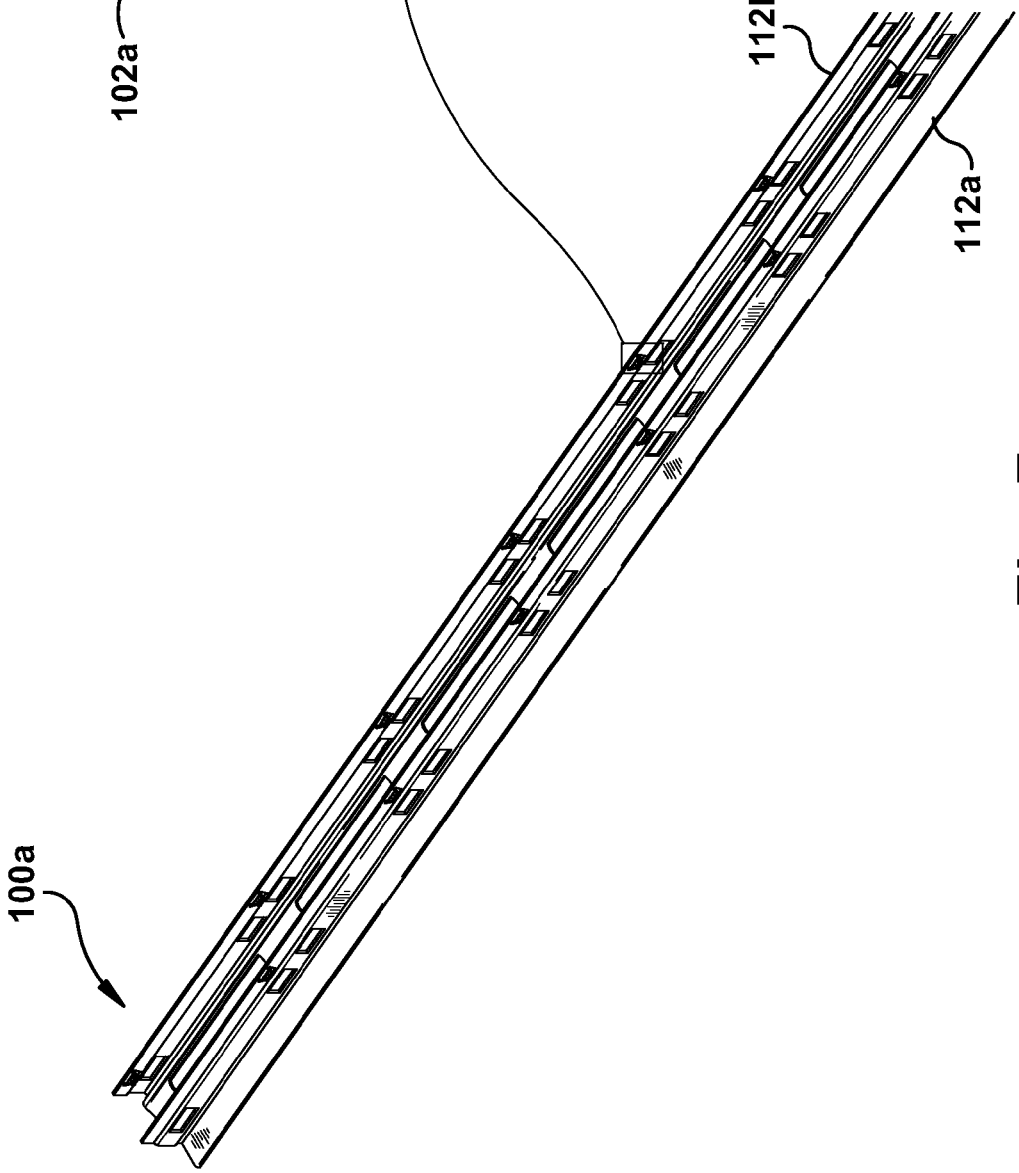
Figure 8:
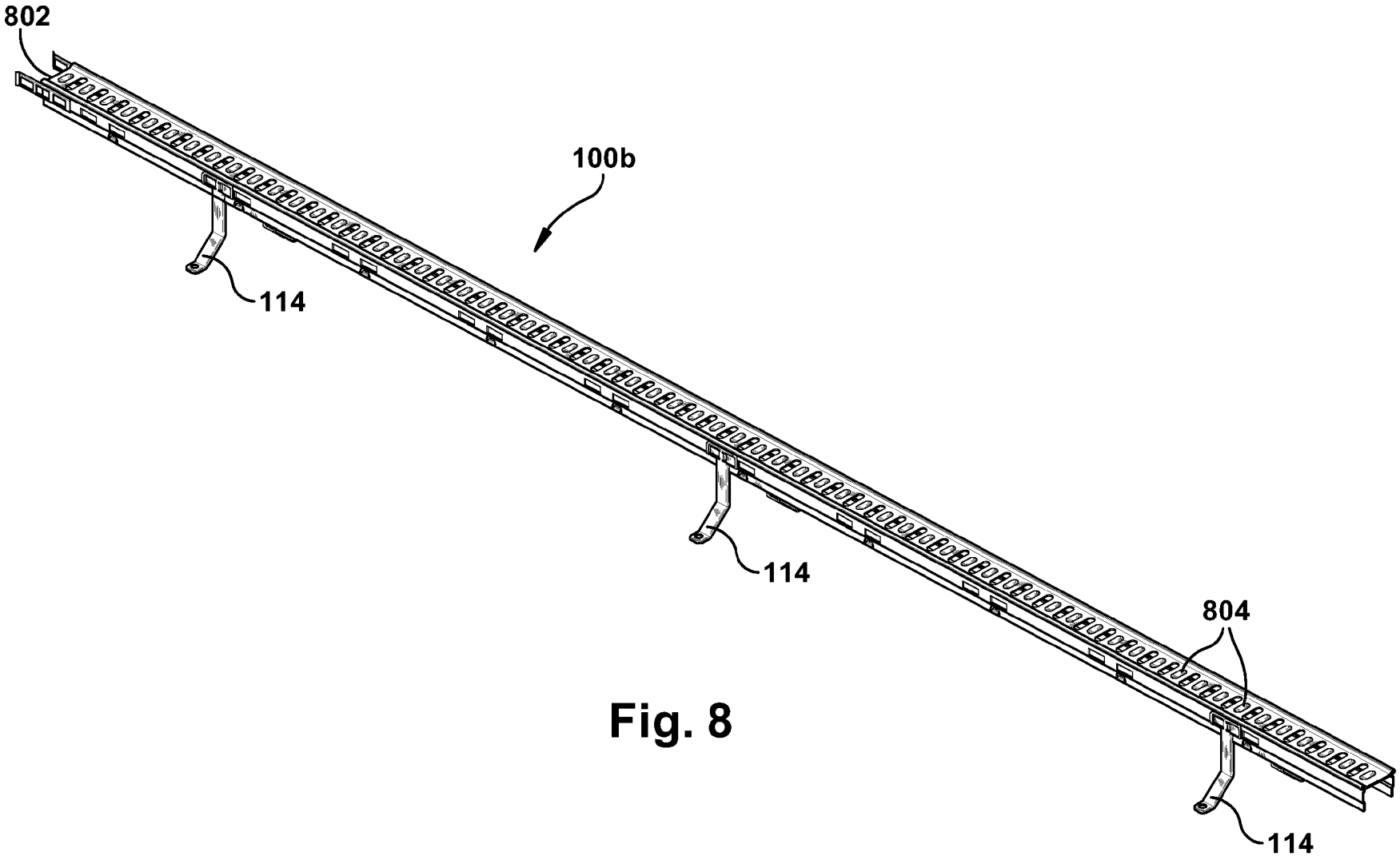
Figure 9:
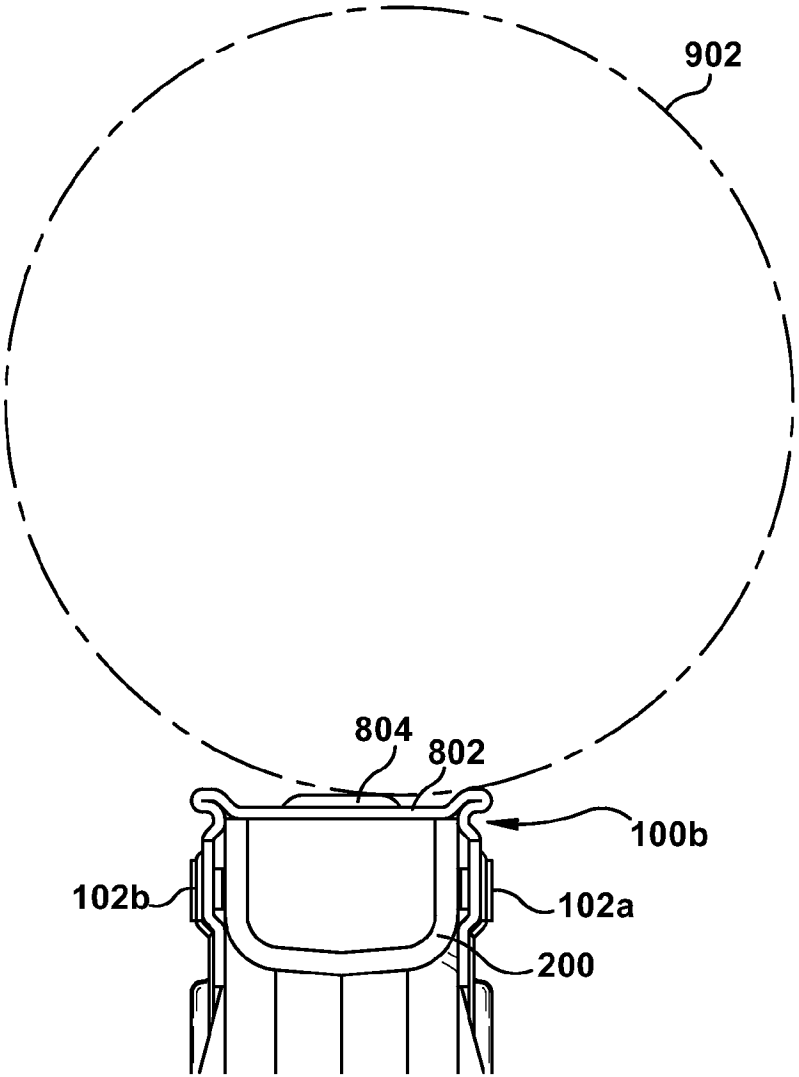

FIG. 7*a* shows the underside of the drain cover portion of FIG. 1 including a drain attachment means;

FIG. 7*b* shows the drain attachment means of FIG. 7*a* in greater detail;

FIG. 8 shows a drain cover portion incorporating projections according to one embodiment of the present invention;

FIG. 9 shows a cross section of the drain cover portion of FIG. 8 in situ covering a drainage system.

Figure 10:
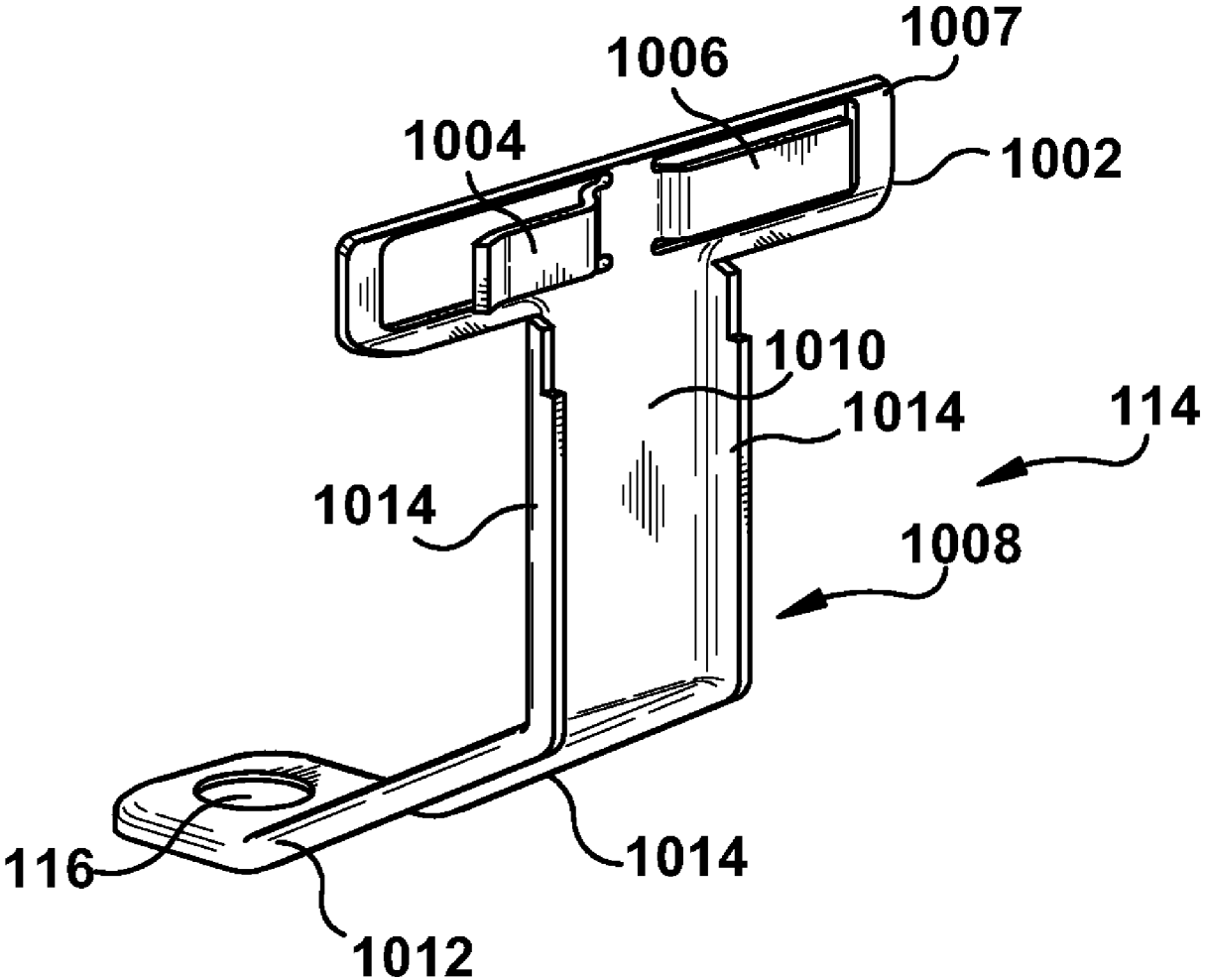
Figure 11:
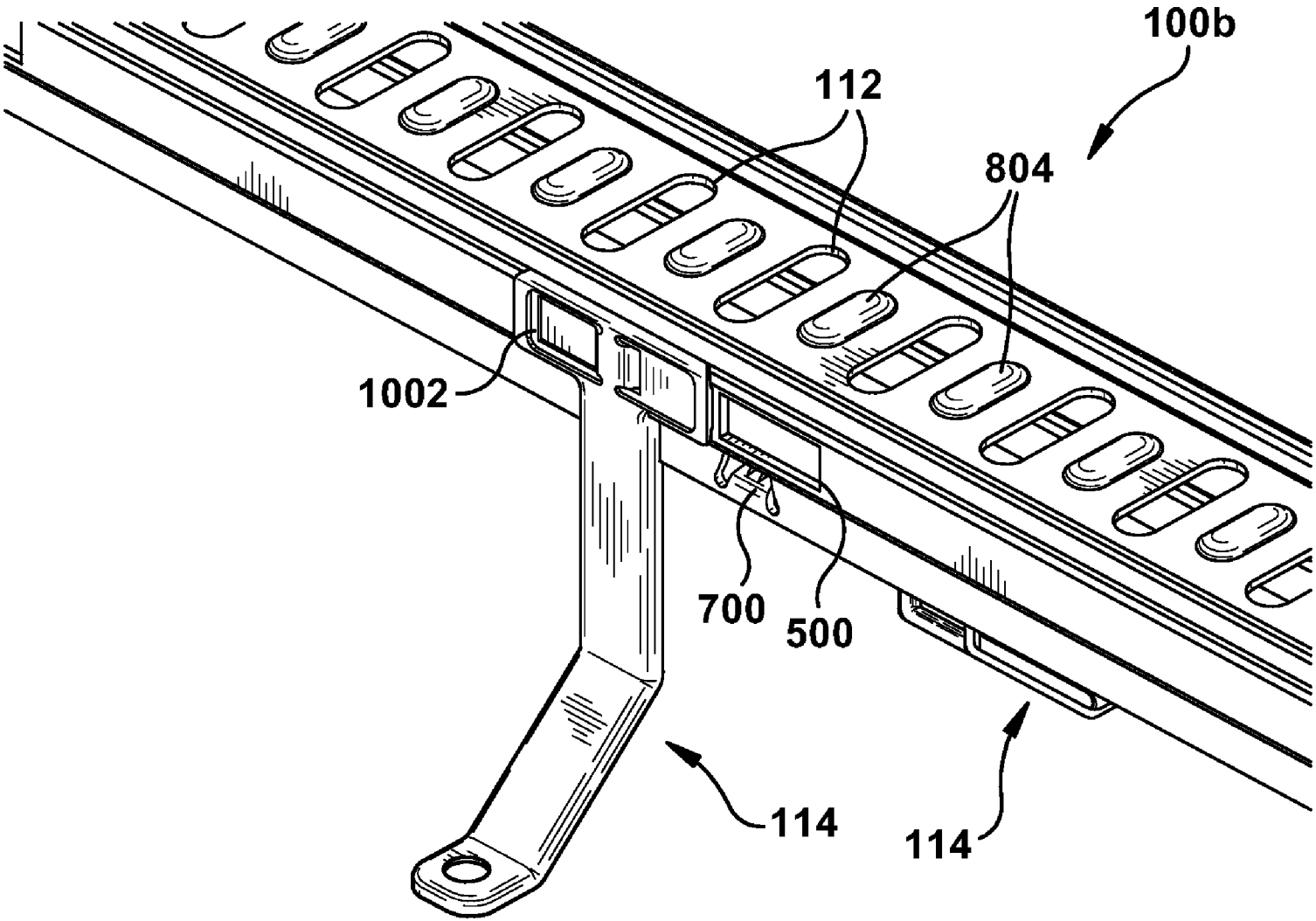
Figure 12B:
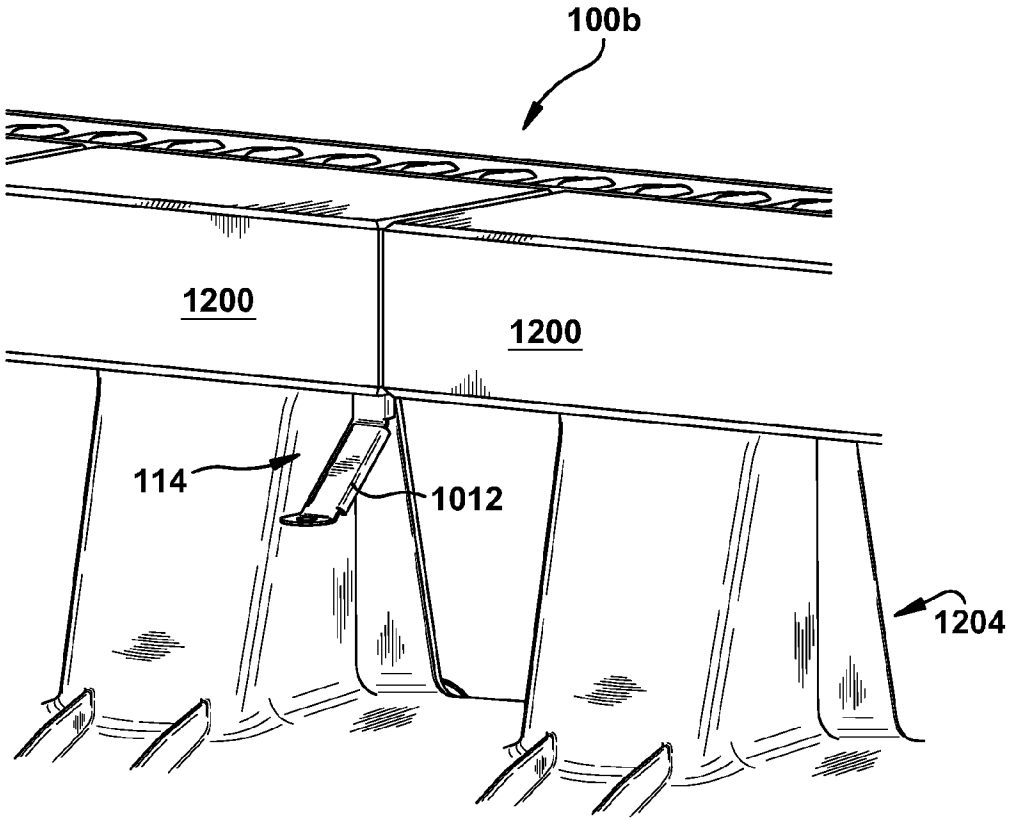
Figure 12A:
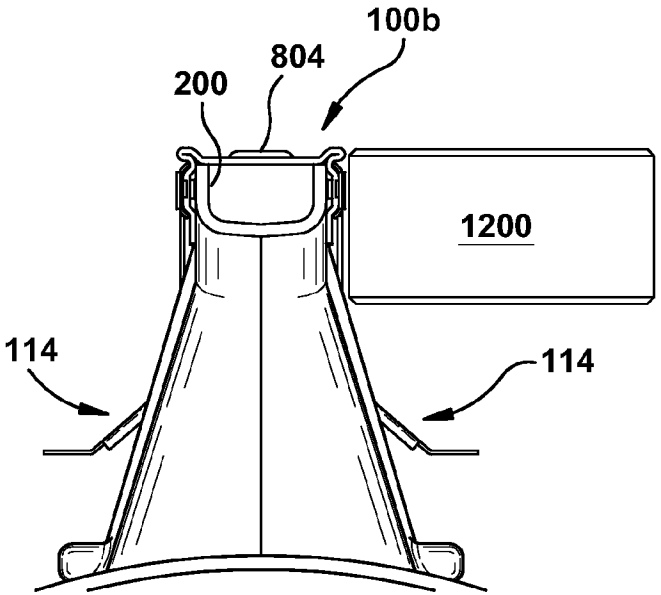
Figure 13:
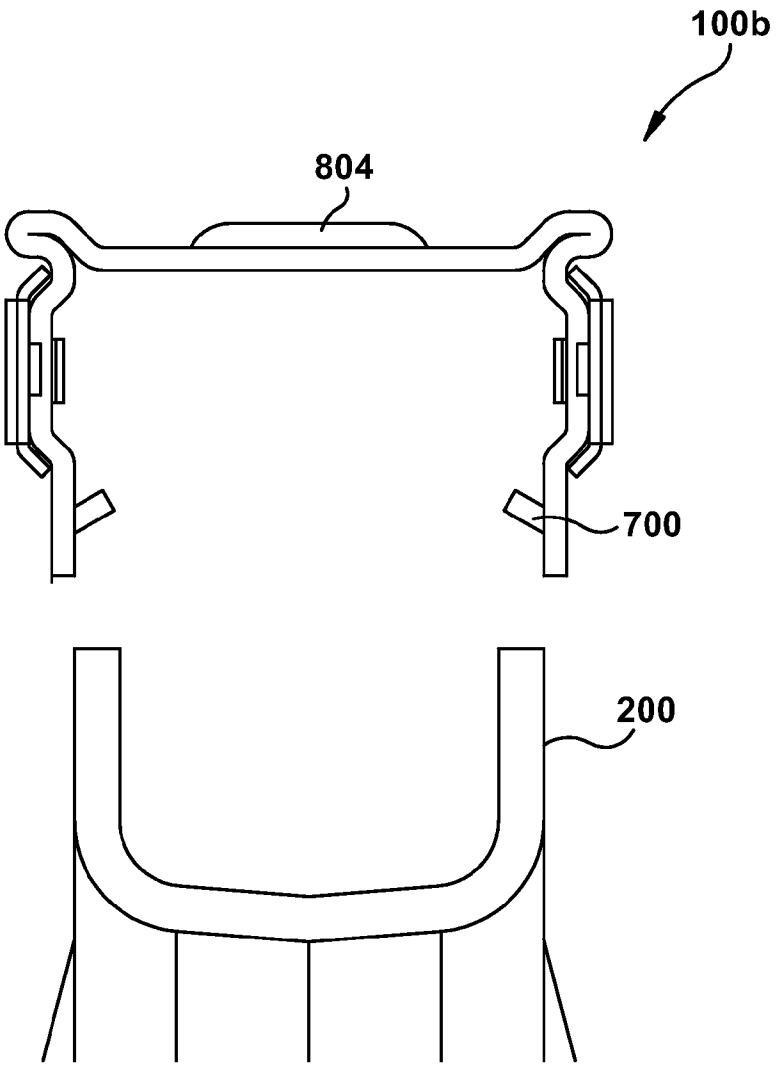
Figure 14:
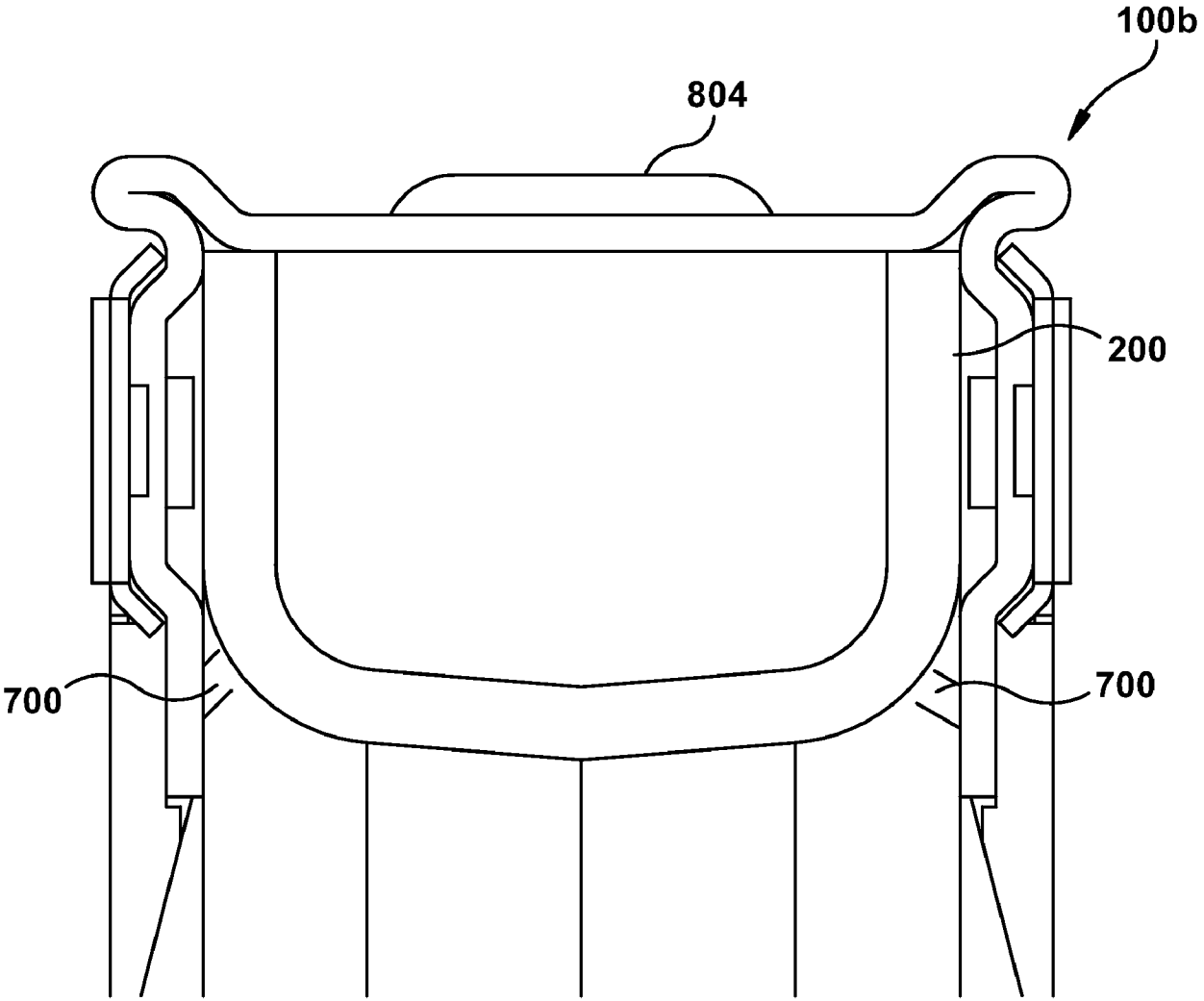

FIG. 10 shows an anchor incorporating an anchor connector;

FIG. 11 shows the anchor of FIG. 10 connected to a drain cover portion;

FIGS. 12*a* and 12*b* shows a cross sectional an perspective view respectively of the drain cover portion of FIG. 11 in situ covering a drainage system embedded in the ground; and FIGS. 13 and 14 show stages in the process of linking drain cover portions to drain portions.

Throughout the following description, like features are labelled with like reference numerals. Two embodiments of a drain cover portion 100*a*, 100*b* are described and where features relate equally to both embodiment, the drain cover portions 100*a*, 100*b* are designated generally as drain cover portion 100.

FIG. 1 shows a drain cover portion 100*a* which comprises a generally longitudinal steel structure. As can be seen from FIG. 2, the cross-section of the drain cover portion 100*a* comprises two substantially parallel side portions 102*a*, 102*b* arranged to fit around the outside of a drain portion 200.

Figure 2:
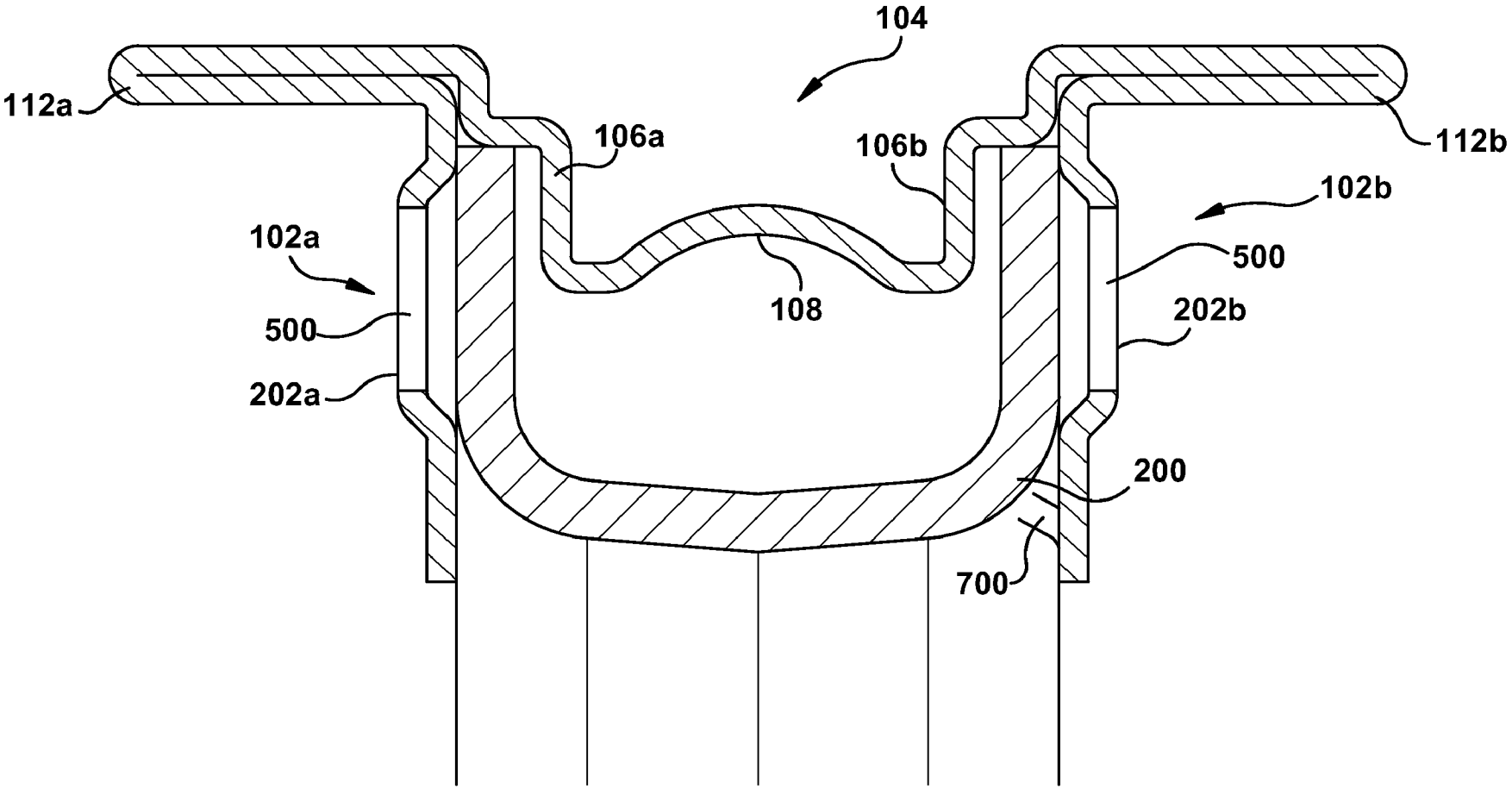
FIG. 2 shows a cross section of the drain cover portion of FIG. 1 in situ covering a drainage system.

The side portions 102*a*, 102*b* are joined by a central portion 104 which comprises two substantially parallel downstands 106*a*, 106*b*, which are arranged to fit inside the drain portion 200 and which are joined by a load bearing portion provided by a slotted inset member 108. The arrangement is such that, when the drain cover portion 100*a* is place in situ over a drain portion 200 as is shown in FIG. 2, the inset member 108 runs parallel with the longitudinal axis of the drain portion 200 and is wholly within the profile of the drain portion 200 such that the mouth of the drain portion 200 is substantially un-obstructed along its entire length.

The slotted inset member 108 comprises a steel body with a series of cut out portions 110 along its length to provide drainage holes through which water may pass into a drain portion there below. The inset member has an arched profile such that, when positioned within a substantially horizontal drain portion, the centre of the inset member is higher than its edges so as to form a gulley between the edges of the inset member 108 and each of the downstands 106*a*, 106*b* The arched profile contributes to the strength of the drain cover portion 100*a* and encourages water and debris to run off slotted inset member 108.

The side portions 102*a*, 102*b* further comprise surface protections flanges 112*a*, 112*b* which are formed along the longitudinal length of the drain cover portion 100 and project outwards. The surface protections flanges 112*a*, 112*b* are arranged to protect the edge region of a building element, for example a concrete slab, or building material such as concrete or asphalt, placed or laid adjacent to a drainage system incorporating the drain cover portion 100 and to ensure that the building element or material does not spall or crack.

Further, each of the side portions 102*a*, 102*b* edge has a projecting portion in the form of a flat side face 202*a*, 202*b*, which provides a projection in the side portions to the exterior of the drain cover portion 100, and against which building elements or materials such as block paviours and asphalt can be laid without creating areas of voiding within the installation (refer also to FIG. 12*a*, showing the flat side face 202*a*, 202*b* adjacent a building element).

The drain cover portion 100 further comprises anchors 114. These provide a tang around which concrete can be cast to ensure that the drain cover portion 100 is fully clamped into concrete. Each anchor 114 has a hole 116 bored into it at its distal end (as is best shown in FIG. 10) through which concrete can flow to ensure that a firm location is achieved. The anchors 114 are attached to the drain cover portion 100 via integral anchor connectors in the form of anchor clips 1002, which are discussed in greater detail with reference to FIG. 10 below.

Figure 5:
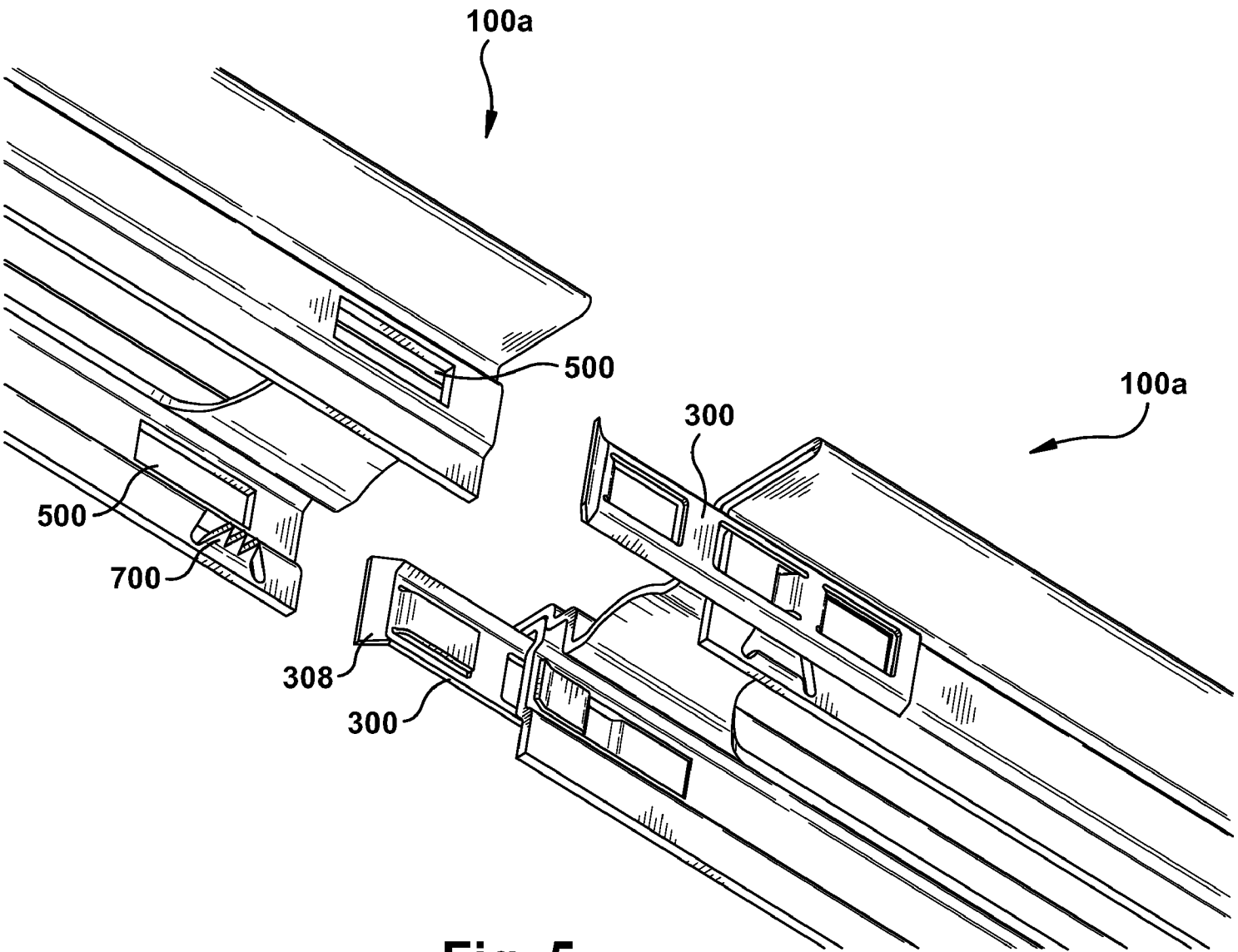
FIGS. 5 and 6 show stages in the process of linking drain cover portions with the drain cover portion connector of FIG. 3.

The side portions 102*a*, 102*b* of the drain cover portion 100 further comprises a plurality of cut-out windows 500 such as can be seen in FIGS. 5 and 11. The cut-out windows 500 provide a connector attachment means to which a connector, such as an anchor connector or a cover portion connector means can be attached.

Figure 3:
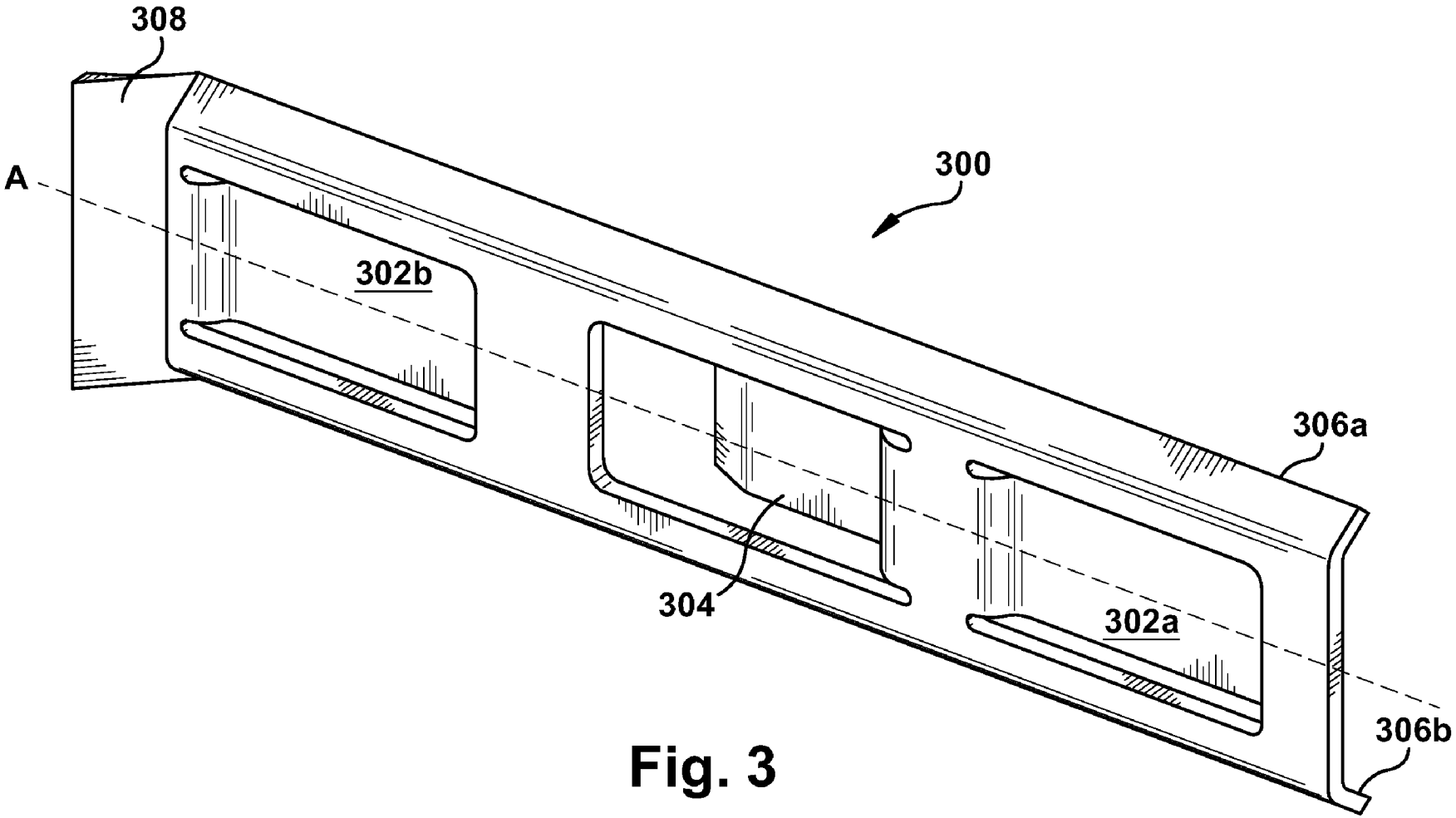
FIG. 3 shows a drain cover portion connector according to one embodiment of the present invention.

An example of a cover portion connector is shown in FIG. 3 and comprises a linking clip 300.

The clip 300 comprises a substantially rectangular one-piece metal body with two U-shaped cuts in arranged therein, the bases of the U's facing each other. The cuts define a first flap 302*a* and a second flap 302*b* which are formed by a portion of the body of the clip which is bent out of the plane of the clip 300. In this embodiment, the first flap 302*a* and second flap 302*b* are arranged parallel to and displaced from the plane of the clip 300.

The clip 300 further comprises a resilient means, also formed from a flap defined by a U-shaped cut in the body. The mouth of the cut-out U forming a resilient means is towards the mouth of the cut-out U defining the first flap 302*a*. This flap is deformed to provide the resilient means in the form of an S-shaped spring 304.

The clip 300 further comprises angled wings 306*a*, 306*b* along its long side which are bent out of the plane of the clip 300 in the same direction as the flaps 302*a*, 302*b* and are arranged to fit around the projections provided by flat side faces 202*a*, 202*b* of the drain cover portion 100. The area of the clip 300 behind the wings 306*a*, 306*b* therefore comprises a recessed portion defined by the wings 306*a*, 306*b* The clip 300 further comprises a tab 308 arranged at the opposite end of the clip to the spring 304 which is bent out of the plane of the clip 300 in the opposite direction as the flaps 302*a*, 302*b* and the wings 306*a*, 306*b* and provides a graspable portion.

The clip 800 is symmetrical about a longitudinal midline A.

Figure 4:
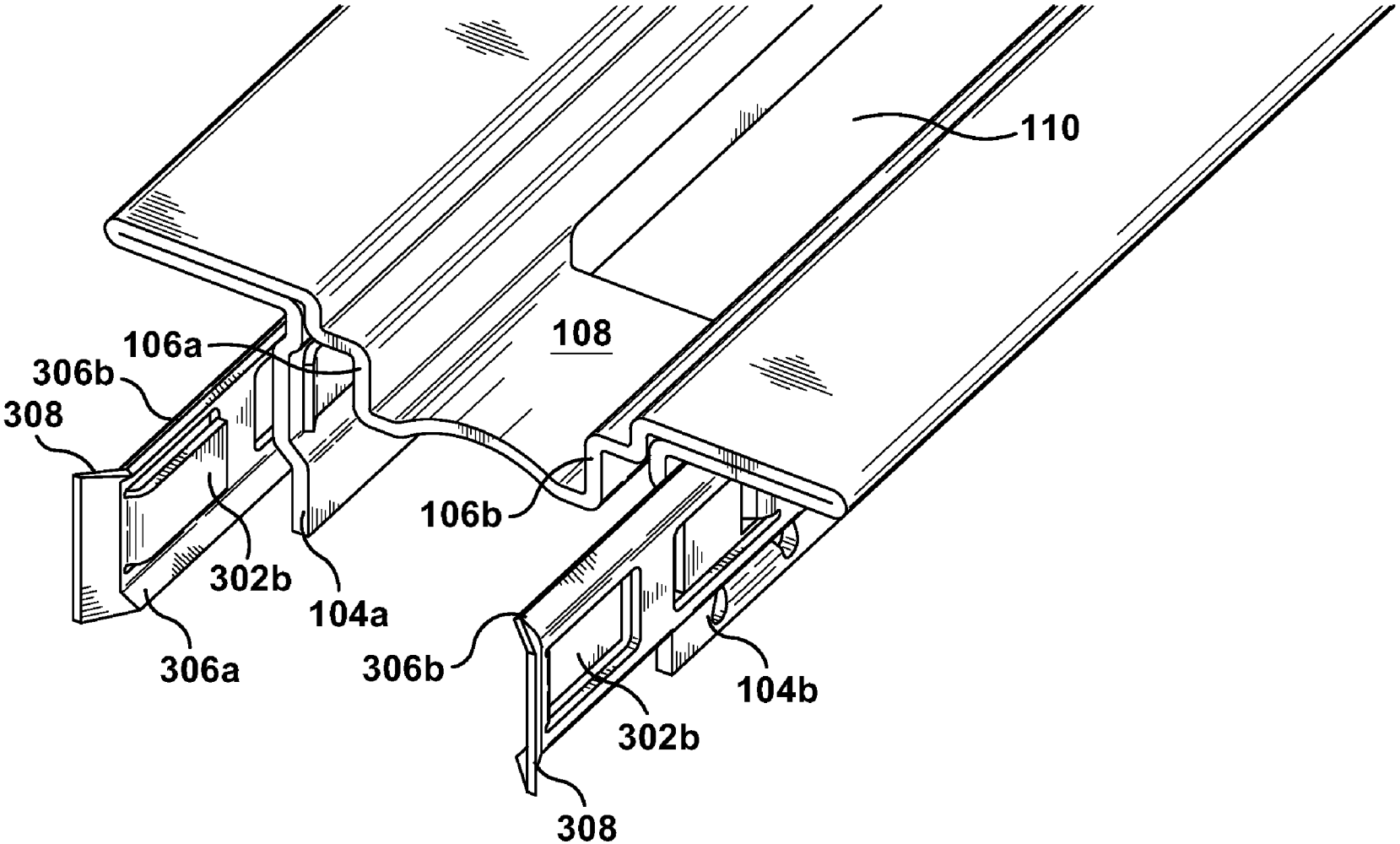
FIG. 4 shows the drain cover portion connector of FIG. 3 attached to a drain cover portion.

In use of the clip 300, as is shown in FIG. 4, the clip 300 is positioned adjacent to the exterior of a window 500 close to the end of a drain cover portion 100 such that the spring 304 protrudes through the window 500. The s-shape of the spring 304 is arranged such that the distal end projects away from the body of the clip 300 and towards the interior of the drain cover portion 100 to allow the ready introduction of the edge of the window 500. The clip 300 is held at the tab 308 and manual pressure is applied until the edge of the window 500 acts to cause the body of the spring 304 to deform by moving slightly away from the body of the clip 300 to allow the clip 300 to be slid with respect to the drain cover portion 100. The clip 300 is moved to a position where the first flap 302*a* can also enter the window 500. The resilience of the first flap causes it to assume a position such that its edge abuts the inside edges of the window 500. The clip 300 is thereby attached to the drain cover portion 100 as portions of the spring 304 are one side of the side portions 102*a*, 102*b* and the body of the clip 300 is on the other side. The abutment of the first flap against the inside of the window prevents the clip 300 from moving in the plane of the side portions 102*a*, 102*b*. The recessed portion defined between the wings 306*a*, 306*b* cooperates with the projecting portions provided by the side faces 202*a*, 202*b* so that the clip 300 is held securely against shifting with respect to the vertical axis of the drain cover portion 100.

Figure 6:
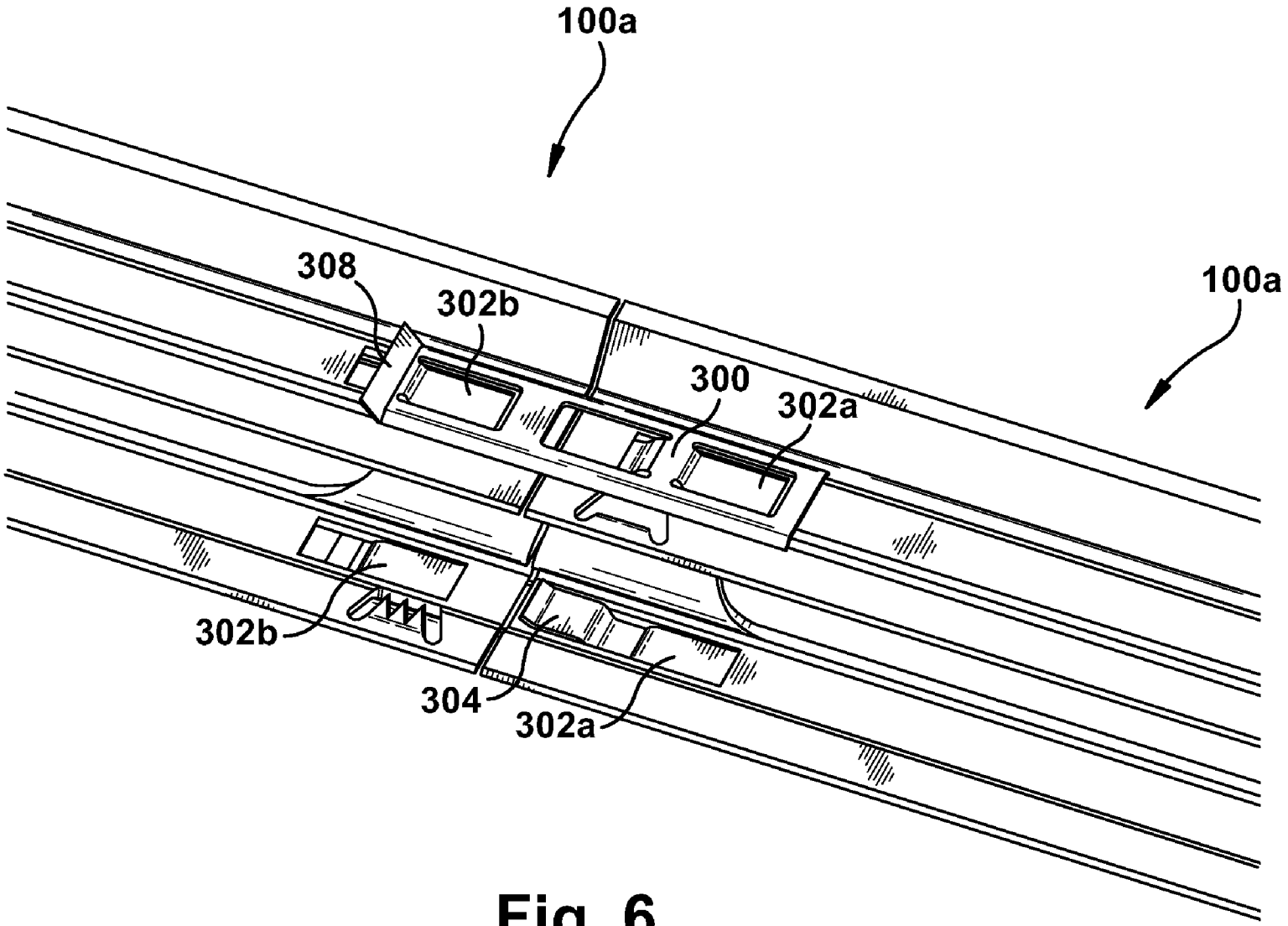

One clip 300 is arranged on each side of the drain cover portion 100, such that there are two horizontally opposed clips, between which another drain cover portion 100 can be fed in order to connect the two drain cover portions 100, as is shown in FIGS. 5 and 6. The tabs 308 act as a guide, assisting the introduction of the drain cover portion 100. The second drain cover portion 100 is simply aligned with the drain cover portion 100 incorporating the clip 300 and the second flap

302*b* is temporarily bent into the plane of the clip as the second drain cover portion 100 is introduced, then springs back when a window 500 close to an end of the second drain cover portion 100 is adjacent thereto. The alignment of the first and second drain cover portion 100 is assured as the recessed portion defined by the wings 306 ensure that the projecting portions provided by the side faces 202*a*, 202*b* are aligned. The entry of the flaps 302*a*, 302*b* into the windows 500 ensures that the cover portions 100 are securely connected. The two connected drain cover portions are equally secured against movement in either the longitudinal axis (i.e. the portions 100 cannot move apart from one another) and the vertical axis (i.e. the longitudinal alignment cannot be lost).

The clips 300 may be removed from a drain cover portion 100 either by manipulating the clip 300 by hand (i.e. grasping the tab 302 between the fingers and thumbs and manually forcing the spring 304 to bend) or by using a lever, for example a screw driver, either behind the tap 308 to bend the spring 304 until the clip 300 can be lifted free of the drain cover portion 100.

The drain cover portion 100 further comprises a drain attachment means arranged to attach the drain cover portion 100 to the drain section 200. The drain attachment means of this embodiment, as is shown in FIGS. 7*a* and 7*b* is integrally provided and comprises a toothed grip 700, which is provided on an interior face of the side portions 102*a*, 102*b* (FIG. 7 shows the underside of the drain cover portion 100 as is shown in FIG. 1). The grip 700 protrudes into the interior of the drain cover portion 100 such that it will firmly grip a drain portion 200 over which the drain cover portion 100 is placed in an interference fit. The grip 700 is angled so as to act in the manner of a barb, making pushing the drain cover portion 100 over a drain section 200 easier than removing it therefrom.

To assemble a drainage system, the drain cover portion 100 is pushed over a drain portion 200 using manual pressure. The grip 700 grips the sides of the drain portion 200 providing a reasonably secure fit. However, drain cover portion 100 may be removed from the drain portion 200 if required, without causing structural damage to the drain portion 200. This may be done manually or with the use of a simple tool such as a crowbar or other lever.

The drain portion 200 is, in this example a plastic drainage portion. The grip 700 will embed itself in the plastic.

FIG. 8 shows an alternative embodiment of a drain cover portion 100, herein termed a rollover drain cover portion 100*b*, in this embodiment comprising a generally longitudinal steel structure. As can be seen from FIG. 9, the cross-section of the rollover drain cover portion 100*b* comprises two substantially parallel side portions 102*a*, 102*b* arranged to fit around the outside of a drain portion 200.

The side portions 102*a*, 102*b* are joined by a load bearing portion in the form of an inset member provided by a slotted central member 802 which is recessed below the tops of the side portions 102*a*, 102*b*. The central member 802 comprises a series of cut out portions 110 along its length to provide drainage holes through which water may pass into a drain portion there below.

The central member 802 further comprise a series of spaced projections 804 with a rounded profile. In this embodiment, the spacing between the tops of the projections 804 is approximately 33 mm. The arrangement is such that, when the drain cover portion 100 is place in situ over a drain portion 200 as is shown in FIG. 2, the slotted central member 802 runs parallel with the longitudinal axis of the drain portion and rests over the mouth of the drain portion 200. Further, the arrangement is such that, when the drainage system is embedded in a surface, the tops of the side walls 102*a*, 102*b* and the tops of the projections 804 are substantially level with the surface (see FIGS. 12*a* and 12*b*).

The projections 804 also act to minimize the flat area between the cut out portions 110, which helps to prevent the build up of debris or water in these areas. FIG. 9 shows the use of such a rollover drain cover portion 100*b* in the context of a typical 'small' wheel 902 such as is seen on supermarket trolley, pushchairs and the like. As can be seen, the projections prevent the wheel 902 from being able to full enter the inset area between the side walls 102*a*, 102*b*, therefore preventing such wheels from being trapped and providing smother passage for wheeled vehicles passing over the rollover drain cover portion 100*b*. In this embodiment, the separation of the projections 804 are dispersed along the length with a spacing of approximately 33 mm. This is to ensure that a trolley wheel will be supported by at least one projection 804 while crossing the rollover drain cover portion 100*b* (typical diameter for a trolley wheel is about 40 mm).

FIG. 10 shows an anchor 114, which, as noted above, provides a tang around which the concrete can be cast. The anchors 114 are attached to the drain cover portion 100 via integral anchor connectors in the form of anchor clips 1002.

The anchor clip 1002 comprises a substantially rectangular metal body with two U-shaped cuts in arranged therein, the mouths of the U's facing each other. One cut defines a flap 1004 which is bent out of the plane of the anchor clip 1002. In this embodiment, the flap 1004 is formed parallel to and displaced from the plane of the clip 1002. The other flap is deformed to provide resilient means an S-shaped anchor spring 1006. The anchor clip 1002 further comprises an angled wing 1007 which is bent out of the plane of the anchor clip 1002 in the same direction as the flap 1004 and is arranged to fit over the edge of the flat side faces 202*a*, 202*b* of the drain cover portion 100.

The anchor 114 further comprises a longitudinal leg 1008 which has a bend along its length such that it comprise a substantially vertical portion 1010 proximal to the anchor clip 1002, and an angled portion 1012 distal from the anchor clip 1002. Both the vertical 1010 and the angled 1012 portions comprises strengthening ribs 1014.

In use of the anchor clip 1002, as is shown in FIG. 11, the anchor clip 1002 is positioned adjacent to the exterior of a window 500 along the length of a drain cover portion 100 such that the anchor spring 1006 protrudes through the window 500. Manual pressure is applied until the body of the anchor spring 1006 moves to allow the anchor clip 1002 to slide with respect to the drain cover portion 100. The anchor clip 1002 is thereby moved to a position where the flap 1004 can also enter the window 500 such that edges of the flap 1004 abut the internal edges of the window 500. The anchor clip 1002 is thereby attached to the drain cover portion 100 as portions of the anchor spring 1006 are one side of the side portions 102*a*, 102*b* and the body of the anchor clip 1002 is on the other side. The abutment of the edges of the flap 1004 against the internal edges of the window prevent the clip 1002 from sliding in the plane of the side faces 202*a*, 202*b*. The angled wings 1007 fit over the edge of a flat side face 202*a*, 202*b* of the drain cover portion 100, providing further stability to the anchor clip 1002 and prevent vertical movement thereof.

The anchor clip 1002 may be removed from a drain cover portion 100*b* either by manipulating the drain cover portion 100 by hand or by using a small lever, for example a screw driver, to bend the spring 1006 until the anchor clip 1002 can be lifted free of the drain cover portion 100.

As is shown in FIGS. 12*a* and 12*b*, the arrangement is such that, in use of a drain cover portion 100 carrying an anchor clip 1002, a building element 1200 is placed against the vertical potion 1010 and the angled portion 1012 then kicks out at an angle of about 45 degrees below the building element 1200, which is set on a concrete bed. Therefore, the angled portion 1012 will be firmly keyed into the concrete but asphalt or block paviour or the like may be laid up to the edge of the drain cover portion 100. FIG. 12*b* shows an ACO QMAX™ drainage system 1204, which is the subject of British Patent Applications GB 0323198.2 and GB 0215979.6.

If however the building element is particularly large and the anchor 114 will prevent it from being laid adjacent to the drain cover portion 100, the anchor 114 can be simply removed. Anchors 114 can be selectively removed and/or repositioned as required, if for example they would interfere with building elements 1200 on one side of the drainage system and not the other, or at one point along the drainage system.

FIGS. 13 and 14 show the installation of a rollover drain cover portion 100*b* over a drain portion 200. The rollover drain cover portion 100*b* shown in FIG. 13 incorporates a clip 300. That shown in FIG. 14 has an anchor 114 attached thereto. To assemble a drainage system, the rollover drain cover portion 100*b* is pushed over the drain portion 200, possibly using manual pressure (see FIG. 13). The grip 700 grips the sides of the drain portion 200 providing a reasonably secure fit (see FIG. 14). However, drain cover portion 100 may be removed from the drain portion 200 if required, without causing damage to the drain portion 200. This may be done manually or may require the use of a simple tool such as a crowbar or other simple lever.

Other embodiments within the scope of the invention will be readily apparent to the skilled person. In particular, elements described in relation to the first embodiment above apply as appropriate in relation to the second embodiment.

The invention claimed is:

1. A drainage system connector arranged to be attached to a drainage system component and comprising a body extending along a plane including a longitudinal axis of the body, and at least one resilient member extending from a first side of the body, the resilient member configured to provide a reception area that is open in a direction of the longitudinal axis and defined between the resilient member and the plane, wherein the drainage system connector is configured to be shifted along the longitudinal axis such that the at least one resilient member is manually deformed as a portion of a drainage system component slides along the first side of the body and enters the reception area so that the drainage system connector is attachable to a drainage system component without the need for tools.

2. The drainage system connector according to claim 1 which comprises a one-piece component.

3. The drainage system connector according to claim 1 which comprises a graspable portion arranged to project from the connector such that it is accessible to a user when the connector is attached to a component.

4. The drainage system connector according to claim 1 which comprises an integrally formed anchor arranged to provide a tang around which concrete can set.

5. The drainage system connector according to claim 4 in which the anchor comprises a substantially vertical portion proximal to the body an angled portion distal from the body arranged such that, in use of a drain cover portion incorporating an anchor, a building element may be placed adjacent to the vertical portion and the angled portion at least partially enters the area below the footprint of the building element.

6. The drainage system connector according to claim 1 which comprises a drain cover portion connector arranged to link a drain cover portion to an adjacent drain cover portion.

7. The drainage system connector according to claim 1, wherein the at least one resilient member comprises flap formed by bending a portion of the body out of the plane.

8. The drainage system connector according to claim 7, wherein the flap is defined by a U-shaped cut in the body.

9. The drainage system connector according to claim 1, wherein the at least one resilient member comprises an S-shaped spring.

10. The drainage system connector according to claim 1, further comprising at least one protrusion extending from the first side of the body.

11. The drainage system connector according to claim 10, wherein the at least one protrusion comprises a flap.

12. The drainage system connector according to claim 10, wherein the at least one protrusion comprises a first protrusion and a second protrusion with the resilient member positioned between the first and second protrusions.

13. The drainage system connector according to claim 1, further comprising a pair of wings extending from the first side of the body and along the longitudinal axis.

14. A drainage system connector, arranged to be attached to a drainage system component, the connector comprising:

a body extending along a plane including a longitudinal axis of the body;

at least one spring comprising a spring flap extending from a first side of the body and open in a direction of the longitudinal axis, the spring flap being formed by bending a first portion of the body out of the plane; and a first locking flap extending from the first side of the body, the first locking flap being formed by bending a second portion of the body out of the plane, wherein the drainage system connector is configured to be shifted along the longitudinal axis such that the at least one spring is manually deformed with a portion of a drainage system being received by the at least one spring and the first locking flap being received by a first locking window of a drainage system component.

15. The drainage system connector according to claim 14, further comprising a second locking flap extending from the first side of the body, the second locking flap being formed by bending a third portion of the body out of the plane.

16. The drainage system connector according to claim 15, wherein the spring flap is positioned between the first and second locking flaps.

17. The drainage system connector according to claim 14, further comprising a pair of wings extending from the first side of the body and along the longitudinal axis.

18. A drainage system connector, arranged to be attached to a drainage system component, the connector comprising:

a body extending along a plane including a longitudinal axis of the body;

at least one spring comprising a spring flap extending from a first side of the body and open in a direction of the longitudinal axis, the spring flap being defined by a U-shaped cut in the body and formed by bending a first portion of the body out of the plane; and a first locking flap extending from the first side of the body, the first locking flap being defined by another U-shaped cut in the body and formed by bending a second portion of the body out of the plane, wherein the drainage system connector is configured to be shifted along the longitudinal axis such that the at least one spring is manually deformed with a portion of a drainage system being received by the at least one spring and the first locking flap being received by a first locking window of a drainage system component.

19. The drainage system connector according to claim 18, wherein an open end of the U-shaped cut defining the first locking flap faces toward an open end of the U-shaped cut defining the spring flap.

20. The drainage system connector according to claim 18, further comprising a second locking flap extending from the first side of the body, the second locking flap being defined by another U-shaped cut in the body and formed by bending a third portion of the body out of the plane.

21. The drainage system connector according to claim 20, wherein an open end of the U-shaped cut defining the first locking flap faces toward an open end of the U-shaped cut defining the spring flap.

22. The drainage system connector according to claim 21, wherein an open end of the U-shaped cut defining the second locking flap faces away the open end of the U-shaped cut defining the spring flap.

23. The drainage system connector according to claim 18, wherein the spring flap is positioned between the first and second locking flaps.

24. The drainage system connector according to claim 18, further comprising a pair of wings extending from the first side of the body and along the longitudinal axis.

* * * * *